US005098099A

United States Patent [19]

Liu

[11] Patent Number: 5,098,099

[45] Date of Patent: Mar. 24, 1992

[54] PROTECTIVE STRIP FOR A RACKET

[76] Inventor: Jeffrey Liu, 4-1 Fl., No. 656, Sec. 4, Pa Teh Rd., Taipei, Taiwan

[21] Appl. No.: 658,769

[22] Filed: Feb. 21, 1991

[51] Int. Cl.[5] ..... A63B 49/14

[52] U.S. Cl. ..... 273/73 R

[58] Field of Search ..... 273/73 R, 73 C, 73 D, 273/73 E, 73 G

[56] References Cited

U.S. PATENT DOCUMENTS 4,204,681 5/1980 Hall, Jr. et al. ..... 273/736

4,836,543 6/1989 Holzer ..... 273/73 D 4,858,928 8/1989 Muroi et al. ..... 273/73 D

*Primary Examiner*—Edward M. Coven

*Assistant Examiner*—Raleigh W. Chiu

*Attorney, Agent, or Firm*—Merchant, Gould, Smith, Edell, Welter & Schmidt

[57] ABSTRACT

A protective strip comprises a base strip and a cover strip, the base strip having a plurality of catgut holes thereon and providing an aperture between the catgut holes, the cover strip having a plurality of pins protruding from a bottom surface thereof for inserting into the apertures on the base strip.

2 Claims, 2 Drawing Sheets

PROTECTIVE STRIP FOR A RACKET

BACKGROUND OF THE INVENTION

This invention relates to a protective strip for a racket head.

Conventionally, a protective strip of a racket head is fastened on a longitudinal channel formed on an outer surface of the racket head by catgut strings to prevent the catgut strings from being strung directly to a frame of the racket head. However, the simple effect of the protective strip is not satisfactory. Since inadvertently dropping or accidentally striking the ground usually lead to damage of the racket, a protective strip with a width equivalent to the frame is desired.

When a user intends to replace a worn-out strip, all catgut strings have to cut and abandoned, even though they may still be useful, and then the racket must be restrung just to replace the protective strip and catgut strings. Such a protective strip is inconvenient and expensive.

It is the purpose of this present invention, therefore, to mitigate and/or obviate the above-mentioned drawback in the manner set forth in the detailed description of the preferred embodiment.

SUMMARY OF THE INVENTION

According to the present invention, there is provided a novel protective strip which comprises a base strip and a cover strip. The base strip is capable of fitting into a longitudinal outer channel of the racket frame and has a plurality of catgut holes corresponding to those on the racket frame for stringing. Additionally, there are apertures formed between the racket holes for holding and fixing the cover strip.

The cover strip is provided with a width substantially equivalent to the frame and has a plurality of pins protruding from a bottom surface thereof, so as to be inserted into the apertures of the base strip.

Therefore, it is a primary object of this invention to provide a protective strip which may be replaced without cutting catgut strings.

It is further an object of this invention to provide a protective strip which is capable of being partially replaced.

DETAILED DESCRIPTION OF THE PREFERRED EMBODIMENT

Figure 1:
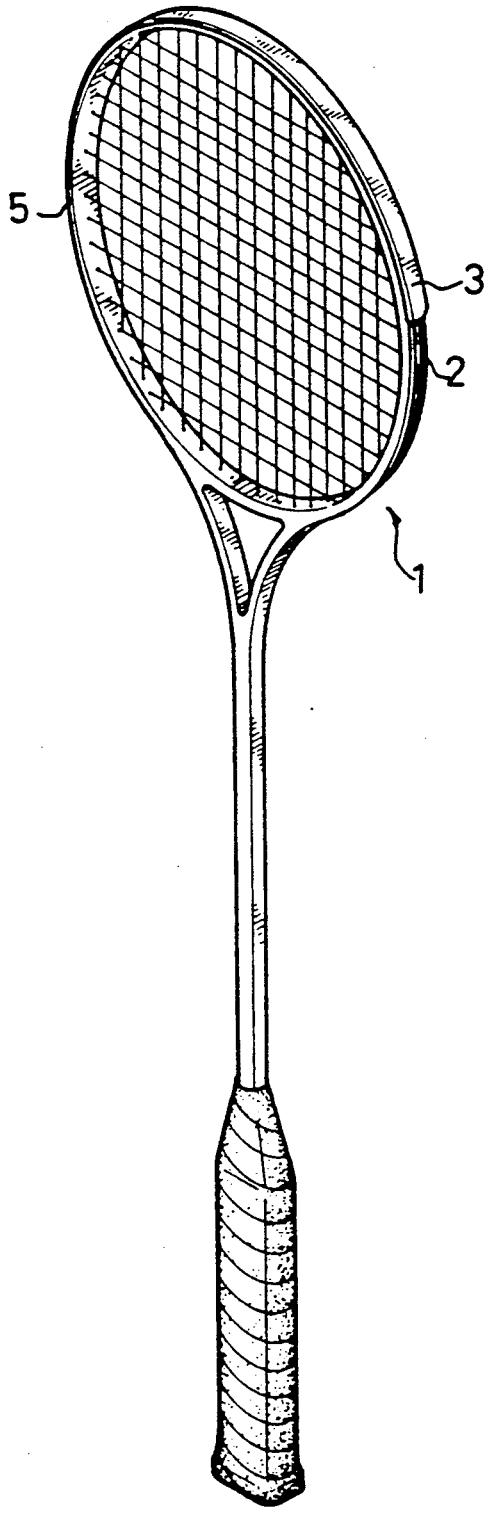
FIG. 1 is a perspective view of a racket head with a protective strip in accordance with this invention.

A protective strip embodying the present invention shown in FIG. 1 and designated by 1 comprises a base strip 2 and a cover strip 3. The strips may be formed of a suitable resilient material. The base strip 2 has a sufficient length to surround a striking surface of a racket head 5 and is formed substantially as a "U" to fit onto a longitudinally U-shaped channel along an outer surface of the frame of the racket head 5, excluding a junction portion with a racket handle.

Figure 2:
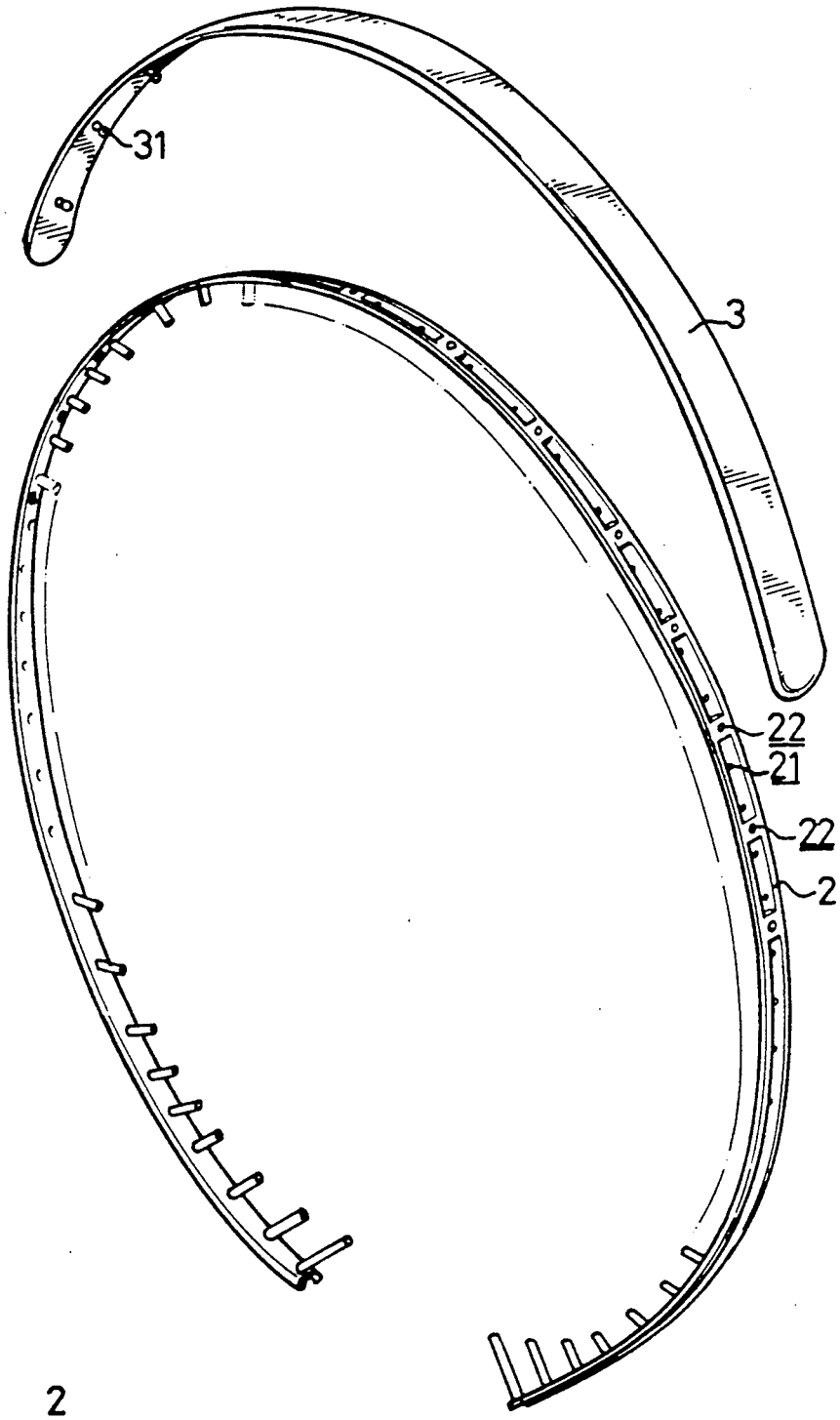
FIG. 2 is a perspective exploded view of a protective strip according to the present invention.

Referring to FIG. 2, the base strip 2 has a plurality of catgut holes at an innermost portion thereof and a tube 21 pointing inwards, i.e., toward the center of the racket head, integrated with each catgut hole to provide a means for preventing catgut strings from directly abutting the frame of the racket head 5.

Furthermore, on a central portion of the base strip 2, i.e., an upper half portion of the racket head 5, there is provided an aperture 22 between each two catgut holes 21. It is noted that a space in the "U" shape around the aperture 22 is filled in with a similar material of the base strip 2.

The cover strip 3 has a length substantially equivalent to that of the central portion of the base strip 2 and a width substantially equivalent to that of the frame of the racket head 5. The cover strip 3 has an arched outer surface, and the thickness of the cover strip 3 being reduced from a central line toward each lateral edge thereof. Thus, when the cover strip 3 is attached onto the base strip 2, it may form a smooth profile for the frame of the racket head 5 and the cover strip 3.

Figure 3:
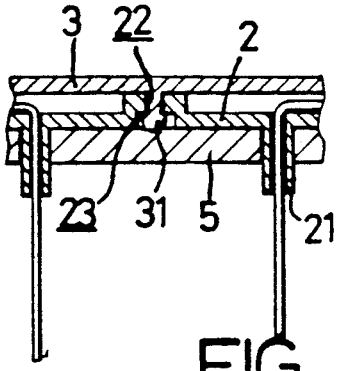
FIG. 3 is a partially longitudinally cross-sectional view of a protective strip according to the present invention.

There are provided a plurality of pins 31 which are formed substantially as a mushroom and protrude from a bottom surface of the cover strip 3 and correspond to apertures 22 of the base strip 2. Thus, referring to FIG. 3, it is possible to insert the pins 31 into the apertures 22 to fix the cover strip 3 onto the base strip 2. It is noted that the aperture 22 has a recess 23 formed around a bottom periphery thereof, so as to engage with an enlarged end of the pin 31 as the pin 31 is inserted into the aperture 22 such that the cover strip 3 may be firmly mounted on the base strip 2. When a user intends to replace a new strip, he merely draws out the cover strip 3 and then insets a new one, without the need of cutting out the catgut strings.

It is to be understood, however, that even though numerous characteristics and advantages of the present invention has been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. A protective strip for a racket frame, comprising:

a base strip, said base strip being substantially U-shaped and including:

a plurality of catgut holes formed in said base strip, each of said catgut holes being aligned with a corresponding hole of the racket frame such that a catgut string is insertable through said catgut holes and the holes of the racket frame, thereby said base strip is fixed to the racket frame; and a plurality of apertures intersperced between said catgut holes; and a cover strip, said cover strip having a bottom surface, said bottom surface having means formed thereon for removeably fixing said cover strip to said base strip after the racket frame and said base strip have been strung, said fixing means mating with said apertures of said base strip.

2. A protective strip in accordance with claim 1, wherein said fixing means comprises a number of flexible pins protruding from said bottom surface, the number of said flexible pins corresponding to the number of said apertures in said base strip, each of said flexible pins including an end larger than said aperture and being insertable into a corresponding aperture of said base strip.

* * * * *